United States Patent [19]

Aono

[11] 4,057,042

[45] Nov. 8, 1977

[54] AIR-FUEL MIXTURE CONTROL APPARATUS FOR INTERNAL COMBUSTION ENGINES USING DIGITALLY CONTROLLED VALVES

[75] Inventor: Shigeo Aono, Seki, Japan

[73] Assignee: Nissan Motor Co., Ltd., Yokohama, Japan

[21] Appl. No.: 630,078

[22] Filed: Nov. 7, 1975

[30] Foreign Application Priority Data

Nov. 8, 1974 Japan ..... 49-128134
Apr. 24, 1975 Japan ..... 50-49175

[51] Int. Cl.[2] ..... F02B 33/00

[52] U.S. Cl. ..... 123/119 EC; 123/32 EE; 60/276; 60/285

[58] Field of Search ..... 123/32 EA, 32 EE, 119 EC; 60/276, 285

[56] References Cited

U.S. PATENT DOCUMENTS

| | | | |
|---|---|---|---|
| 3,643,635 | 2/1972 | Milam | 123/32 EA |
| 3,659,571 | 5/1972 | Lang | 123/32 EA |
| 3,673,989 | 7/1972 | Aono et al. | 123/32 EA |
| 3,750,631 | 8/1973 | Scholl et al. | 123/32 EA |
| 3,786,788 | 1/1974 | Suda et al. | 123/32 EA |
| 3,820,517 | 6/1974 | Nambu | 123/32 EA |
| 3,861,366 | 1/1975 | Masaki et al. | 123/32 EA |
| 3,895,611 | 7/1975 | Endo et al. | 123/32 EE |
| 3,911,884 | 10/1975 | Moriya et al. | 60/276 |
| 3,921,612 | 11/1975 | Aono | 123/32 EA |
| 3,923,016 | 12/1975 | Hoshi | 123/32 EE |
| 3,960,118 | 6/1976 | Konomi et al. | 60/276 |
| 4,019,470 | 4/1977 | Asano | 123/32 EE |

OTHER PUBLICATIONS

Millman & Taub; Pulse, Digital & Switching Waveforms; McGraw-Hill pp. 438-442.

*Primary Examiner*—Ronald H. Lazarus
*Assistant Examiner*—Andrew M. Dolinar

[57] ABSTRACT

A multivibrator circuit is provided to digitally control an electromagnetic valve adapted to control the supply of fuel and air to each cylinder of an internal combustion engine.

1 Claim, 8 Drawing Figures

AIR-FUEL MIXTURE CONTROL APPARATUS FOR INTERNAL COMBUSTION ENGINES USING DIGITALLY CONTROLLED VALVES

The present invention relates to a closed loop air-fuel mixture ratio control apparatus for an internal combustion engine.

In an internal combustion engine of the type in which fuel injection is controlled by electromagnetic valves as a function of an operating parameter of the engine, the valves are required to closely follow the minute variations of the input signal at a given operating condition of the engine. However, the use of analog displacement type control valves is uneconomical.

Therefore, an object of the invention is to provide a simple, economical pulse generating circuit with which the valves are intermittently operated.

Another object of the invention is to permit the use of low cost electromagnetic valves.

The invention will become apparent from the following description when taken in conjunction with the accompanying drawings, in which.

Figure 1:
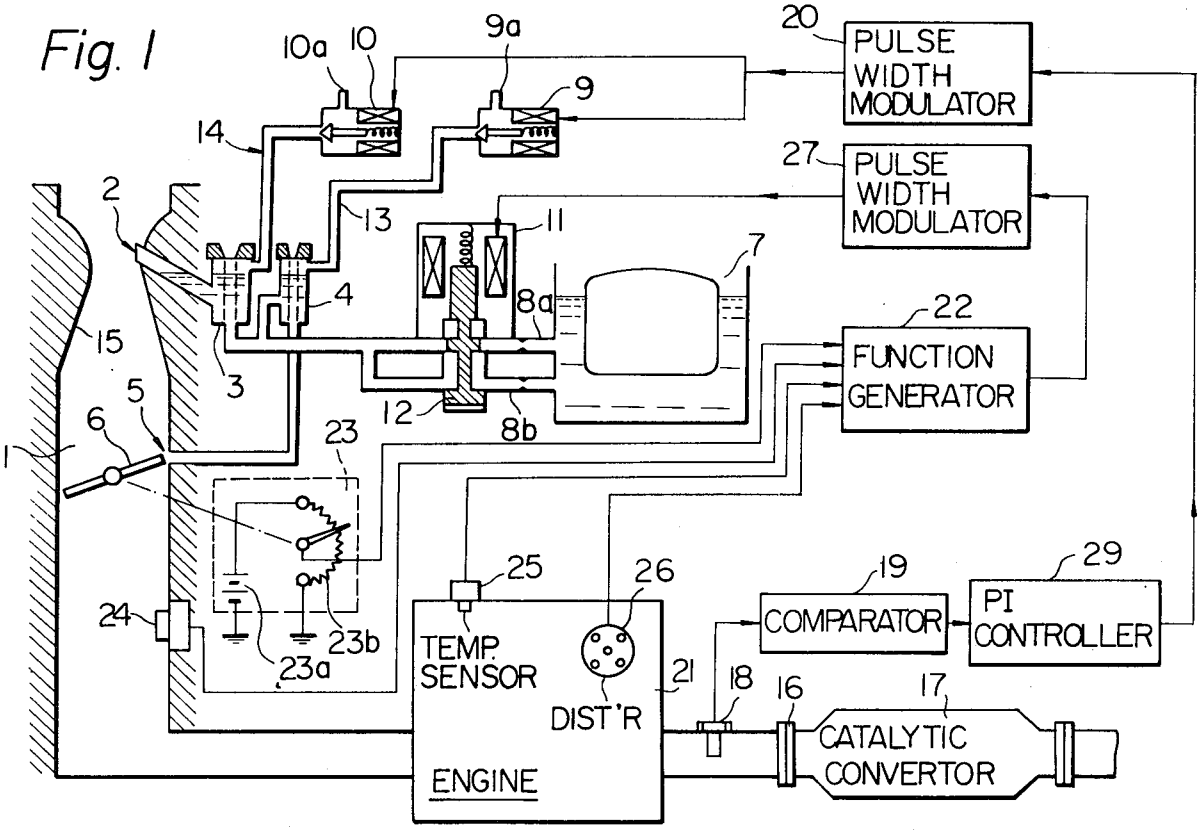
FIG. 1 is a circuit block diagram of an embodiment of the invention.

Referring now to FIG. 1 a general circuit diagram of the air fuel mixture control circuit of the invention is shown. Reference numeral 1 indicates the intake passageway connected to a cylinder of an engine 21. A discharge nozzle 2 is provided at the venturi 15 of the intake passageway 1. The discharge channel 2 is in communication with an air bleed chamber 3 which has its air inlet port connected to an electromagnetic valve 10. An air bleed chamber 4 is in communication with an idle port 5 adjacent to the throttle valve and has its air inlet port connected to an electromagnetic valve 9. The air bleed chambers 3 and 4 have their fuel inlet ports connected in common to a fuel supply 7 via bifurcated passageways 8*a* and 8*b*. The passageways 8*a* and 8*b* have different diameters to permit fuel to be supplied at different rates. To achieve the different flow rates, an electromagnetic valve 11 is provided having a plunger 12 disposed in the respective passageways 8*a* and 8*b* in such manner than either one of the passageways 8*a* and 8*b* is blocked while the other is allowed to pass fuel to the air bleed chambers 3 and 4. The electromagnetic valves 9 and 10 are operated by control pulses supplied from a pulse width modulator 20, and the electromagnetic valve 11 is under the control of a pulse width modulator 27. Air is admitted through ports 9*a* and 10*a* of valves 9 and 10, respectively, through air bleed passageways 13 and 14 to the air bleed chambers 3 and 4, respectively, where fuel is mixed with the air to provide emulsion. By controlling the width of the pulse supplied to the electromagnetic valves 9 to 10, the ratio of air to fuel can be controlled.

The air fuel mixture control circuit of the invention further includes various sensing devices which detect the operating conditions of the engine 21. The opening of the throttle 6 is detected by a throttle sensor 23 having a DC voltage source 23*a* and a potentiometer 23*b* connected to the source 23*a*. The potentiometer 23*b* has its tap point connected by a linkage to the throttle valve 6 such that the tap point varies in accordance with the variation of the throttle angle. An electrical signal corresponding to the throttle opening is obtained between the tap point and one terminal of the potentiometer 23*b*, and coupled to a function generator 22. Intake vacuum pressure is mesured by a vacuum sensor 24 provided on the inner wall of the intake passageway 1 and converted into a proportional signal which is applied to the function generator 22. A temperature sensor 25 is provided to measure the temperature of the engine 21 and couples the temperature-related signal to the function generator 22. Also connected to the function generator 22 is an engine-speed related signal supplied from a distributor 26.

In order to control the air fuel mixture ratio under the feedback control principle, an oxygen sensor 18 is provided on the inner wall of the exhaust pipe 16 to which is connected a catalytic converter 17. The oxygen sensor 18 produces an output voltage with a very sharp characteristic change in amplitude, almost a step change, at the stoichiometric air fuel mixture and a low output voltage for a lean mixture. The output from the oxygen sensor 18 is connected to a comparator or differential amplifier 19 which compares it with a reference voltage and provides an output representative of the difference between the two voltages. The comparator output is connected to a proportional-integral controller 29 which has a control characteristic both a proportional as well as an integrating characteristic.

The pulse width modulators 20 and 27 generate pulses, the width of which is determined by the input voltages respectively supplied from the output of function generator 22 and the output of PI controller 29.

It will be noted therefore that the voltage outputs detected by the various engine condition sensors provide information on the parameters of the engine 21 prior to each combustion while the voltage output obtained from the PI controller 29 provides information on the results of the combustion during each cylinder cycle. Thus, the electromagnetic on-off valves 9 and 10 are operated by the post-combustion engine operating information, while electromagnetic valve 11 is operated by the pre-combustion engine operating information.

Figure 2:
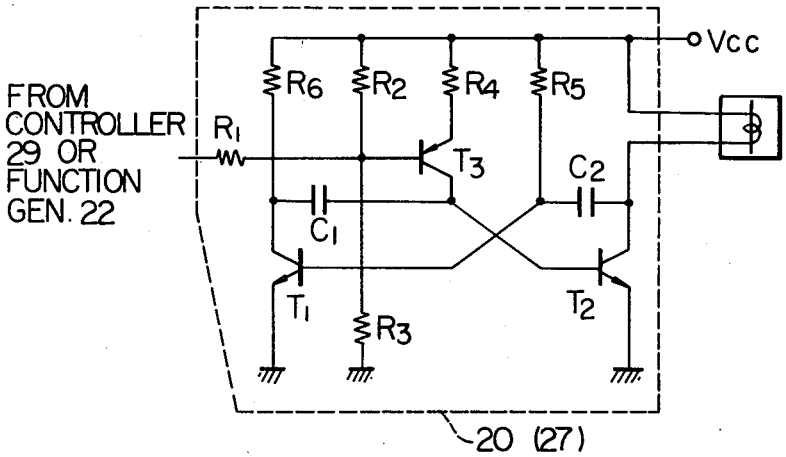
FIG. 2 is a circuit diagram of a pulse width modulator employed in the circuit of FIG. 1.

In FIG. 2 there is shown a detailed circuit diagram of the pulse width modulator 20 or 27 of the invention. Each of the modulators comprises switching transistors T1 and T2, and a constant-current transistor T3. The transistor T1 has its collector connected to a voltage source $V_{cc}$ via a resistor R6 and its emitter electrode connected to ground and its base electrode connected to the voltage source via a resistor R5 and further connected to the collector of transistor T2 via a capacitor C2. The transistor T2 has its collector electrode connected to the voltage source via one of the electromagnetic valves 9 to 11 and its emitter electrode connected to ground, and its base electrode connected to the collector electrode of transistor T1 via a capacitor C1 and further connected to the collector electrode of transistor T3. The transistor T3 has its emitter electrode connected to the voltage source via a resistor R4 and its base electrode connected to the output of PI controller 29 or the output of function generator 22 via a resistor R1. The transistors T1 and T2 have one conductivity type, i.e., n-p-n conductivity type, while transistor T3 has the opposite conductivity type, i.e., p-n-p. The base electrode of transistor T3 is normally held at a constant bias potential determined by the voltage divider comprising resistors R2 and R3 connected in series across the voltage source *Vcc* and the ground reference. Therefore, the output from the controller 29 is impressed upon the bias potential to modulate the overall base voltage of transistor T3. An electromagnetic valve is connected between the voltage source and the collector of transistor T2.

Figure 3:
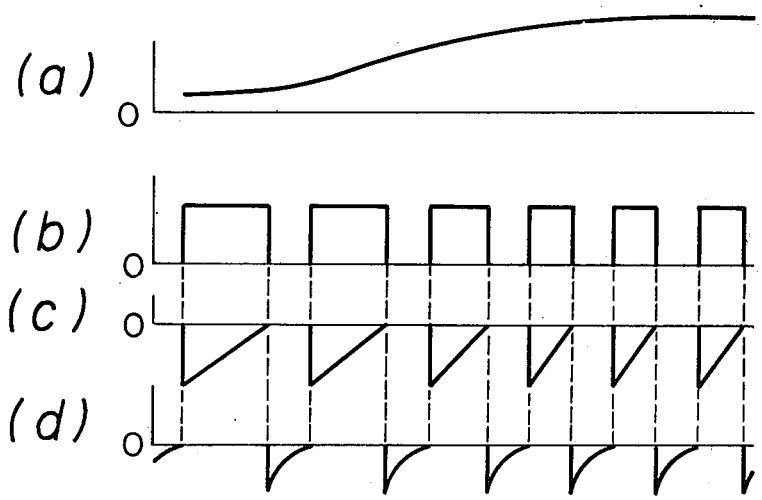
FIG. 3 is a waveform diagram useful for describing the circuit of FIG. 2.

If the voltage at the base electrode of transistor T3 is held at a constant value, transistors T1 and T2 alternately switches on and off at a predetermined frequency with their pulse durations being at constant values determined by the time constants of their RC networks. However, if the base voltage is varied in accordance with the output from the controller 29 (or function generator 22), the duration of on-off times varies accordingly. Assume that the base potential (FIG. 3*a*) approaches the supply voltage *Vcc*, the current that passes through the collector-emitter path of transistor T3 to the capacitor C1 increases and the capacitor C1 will be charged rapidly, thus rendering the off time of transistor T2 short (FIG. 3*c*). On the other hand, if the base potential approaches the ground potential, the capacitor C1 will be charged at a slower rate than before, thus causing transistor T2 to remain in the off condition for a longer period. Therefore, the off period of transistor T1 is held constant (FIG. 3*d*) and the off period of transistor T2 is rendered variable dependent upon the voltage applied to the base electrode of transistor T3. The current that drives the electromagnetic valve intermittently flows through the transistor T2 as shown in FIG. 3*b*. Each of the valves 9 to 10 is designed to be open when the electromagnetic coil is energized by the high level output and closed when the coil is de-energized as the output goes low, so that the valve open time is proportional to the voltage applied to the base electrode of transistor T3. It will be understood that transistors T1 and T2 provide astable multivibrator action while transistor T3 provides an input-dependent current which charges capacitor C1 linearly with time to provide a train of output pulses having variable width proportional to the input voltage.

Figure 4:
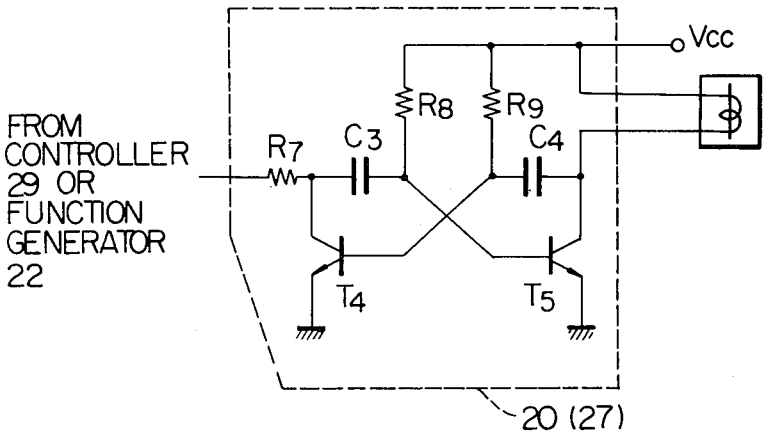
FIG. 4 is a circuit diagram of an alternative form of the circuit of FIG. 2.
Figure 5:
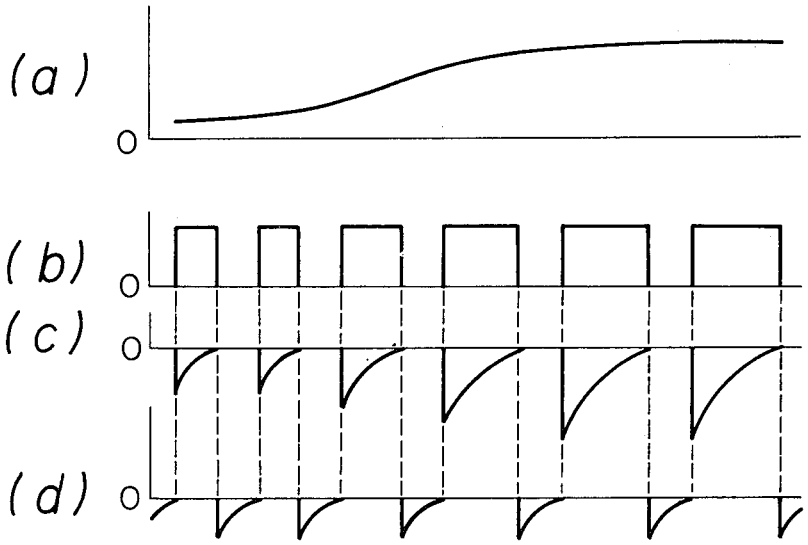
FIG. 5 is a waveform diagram useful for describing the circuit of FIG. 4.

An alternative arrangement is illustrated in FIG. 4. A transistor T4 has its collector electrode connected to the output of PI controller 29 (or function generator 22) via a resistor R7 and its emitter electrode connected to ground, and its base electrode connected to the voltage source *Vcc* via a resistor R9 and further connected to the collector electrode of transistor T5 via a capacitor C4. The transistor T5 has its base electrode connected to the voltage source *Vcc* via a resistor R8 and further connected to the collector of transistor T4 via a capacitor C3, and its emitter electrode connected to ground. One of the electromagnetic valves 9 to 10 is connected across the voltage source *Vcc* and the collector of transistor T5. The collector potential of transistor T4 is thus directly under the control of the output from the controller 29 (or function generator 22). The transistors T4 and T5 constitute an astable multivibrator. As the input voltage at the collector electrode of transistor T4 rises as shown in FIG. 5*a*, the duration of output pulses at the collector electrode of transistor T5 increases (FIG. 5*b*). Each of the electromagnetic valves 9 to 11 is designed to be open when the collector voltage is high and closed when it goes low. Therefore, the valve open time is proportional to the control voltage provided by the controller 29 (or function generator 22).

Figure 6:
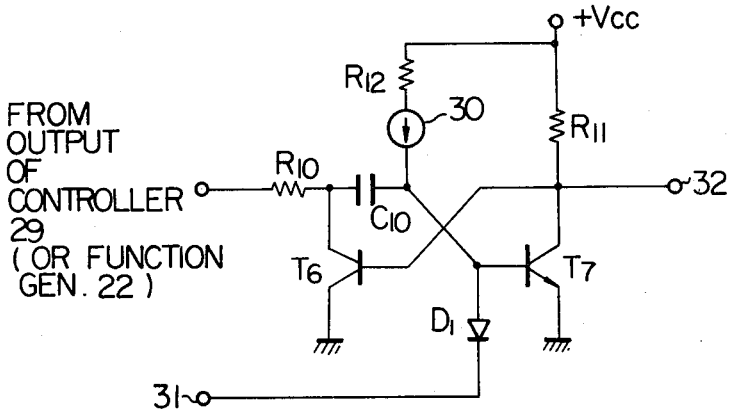
FIG. 6 is a circuit diagram of a further alternative form of the circuit of FIG. 2.
Figure 7:
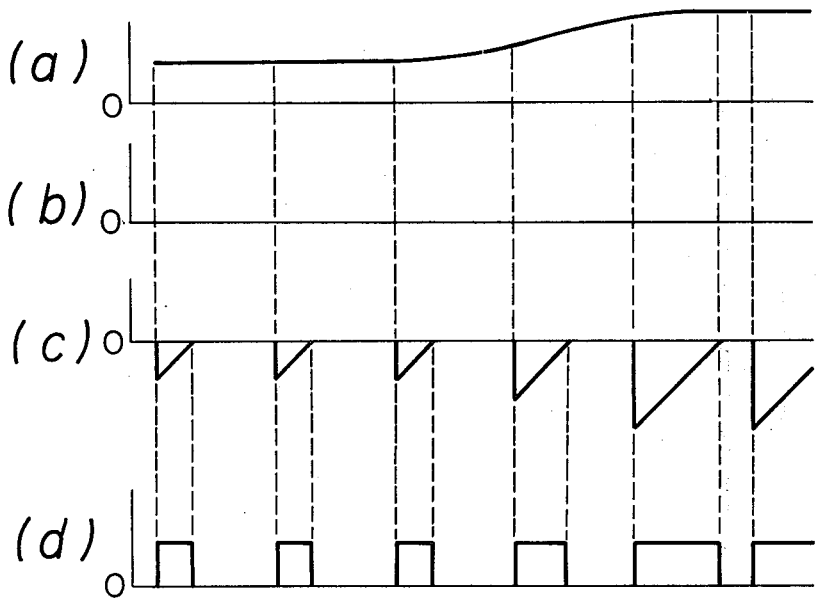
FIG. 7 is a waveform diagram useful for describing the operation of the FIG. 2 circuit.

The pulse width modulator of the invention is further modified as shown in FIG. 6 in which transistors T6 and T7 are connected in a monostable multivibrator configuration. The transistor T6 has its collector electrode connected to the output of controller 29 (or function generator 27) via a resistor R10, has its emitter electrode connected to ground and its base electrode connected to the voltage source *Vcc* via a resistor R11 and directly coupled to the collector of transistor T7. The transistor T7 has its base electrode connected to the collector of transistor T6 via a capacitor C10 and further to the voltage source via a constant current source 30 and a resistor R12, has its collector connected to the voltage source via the resistor R11 and has its emitter electrode connected to ground. The base electrode of transistor T7 is further connected to a trigger input terminal 31 to which regularly occurring negative going pulses are applied. The trigger pulses (FIG. 7*b*) cause transistor T7 to switch to the off state when applied to the base electrode thereof via a diode D1. The potential at the collector of transistor T7 goes high. The collector potential is transmitted to the base electrode of transistor T6 and turns it on, causing its collector potential to go low. At this moment, the base electrode of transistor T7 is held negative by an amount equal to the voltae (FIG. 7*a*) at the output of controller 29 (or function generator 22) and whereupon the capacitor C10 will be charged by the current supplied from the constant current source 30 through the collector emitter path of transistor T6. As shown in FIG. 7*c*, the potential at the base electrode of transistor T7 rises linearly with time from the negative level to which the base has been brought by the output of controller 29. While the base of transistor T7 is held negative, the potential at the collector of transistor T7 remains high, thus producing a train of pulses, the duration of which pulses is dependent upon the voltage at the output of controller 29 (or function generator 22) as shown in FIG. 7*d*. The pulses thus obtained at the collector of transistor T7 is available at an output terminal 32 to energize the electromagnetic valve as mentioned above.

Figure 8:
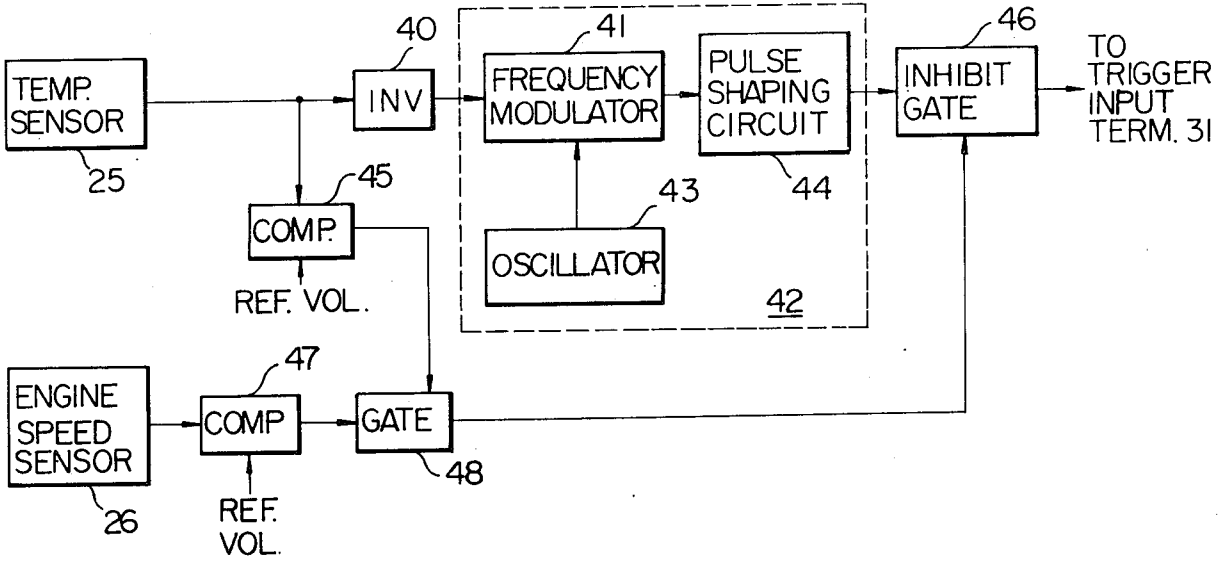
FIG. 8 is a block diagram of a circuit which provides triggering pulses as a function of operating parameters of the engine.

The transistor T7 can be triggered at variable rates in accordance with the output from the temperature sensor 25 and engine speed sensor 26. As shown in FIG. 8 the output from the temperature sensor 25 is inverted by an invertor 40 and fed into a frequency modulator 41 of a pulse generator 42. The output from the sensor 25 is also coupled to a comparator 45 which provides an output only when the input is above a predetermined voltage so that the signal at the output of the comparator 45 represents that the engine 21 has been warmed up and no signal indicates that the engine 21 is being started under low temperature (cold starting). The inverted signal is used to modulate the frequency of pulses supplied from an oscillator 43. When the engine is under cold starting condition, a high level signal is fed into the frequency modulator 41 so that the output frequency is increased to a maximum. The modulated signal is connected to a pulse shaping circuit 44 to provide narrow width pulses for the triggering purpose. The output pulses are passed through an inhibit gate 46 to the trigger input terminal 31 coupled to transistor T7. The output from the engine speed sensor 26 is compared with a predetermined voltage by a comparator 47 which provides an output when the engine speed is below the predetermined value in order to detect the decelerating condition of the vehicle. Once the engine has been warmed up, a signal is present at the output of comparator 45, the output from comparator 47 will be passed through a gate 48 to the inhibit gate 46 so that when the vehicle is decelerated producing an output from comparator 47, the trigger pulses will be inhibited from passing the gate 46 to the trigger input terminal 31. It will be noted therefore that during the cold starting period, high repetition pulses will be produced and transistor T7 triggered thereby at that repetition rate. If the repetition rate at the cold starting is chosen so that the interval between successive trigger pulses is smaller than the interval required to charge capacitor C10, the potential at the collector of transistor T7 goes low, thus causing electromagnetic valves 9 and 10 to close. On the other hand, when the engine speed is lowered at vehicle deceleration producing an output at the comparator 47, no trigger signal is applied to the base electrode of transistor T7 so that potential at the collector thereof remains high, thus causing the electromagnetic valves 9 and 10 to remain open.

What is claimed is:

1. Emission control apparatus for an internal combustion engine having, an induction pipe having a venturi, an exhaust pipe, an air-fuel mixing chamber communicated to the venturi of the induction pipe for delivery of a mixture of air and fuel to the induction pipe by the venturi action, a source of fuel at atmospheric pressure, fuel supply conduit means for delivery of fuel from said source to said mixing chamber, air bleed conduit means for delivery of air to said mixing chamber, and a pulse operated air-fuel proportioning device disposed in the fuel supply and air bleed conduit means to control the ratio of air and fuel delivered to said mixing chamber in response to pulse signals applied thereto, the apparatus including:

means disposed in the exhaust pipe for sensing the concentration of an exhaust composition of the emissions from the engine to provide a concentration representative signal;

means comparing the concentration representative signal with a reference value representing a desired air-fuel ratio to provide a signal representative of the deviation of the detected concentration from the desired value; and means modulating the magnitude of the deviation representative signal in accordance with a predetermined control characteristic to provide an error correction signal;

a pulse-width converter converting the error correction signal into a train of pulses with a duration dependent upon the magnitude of the error correction signal, wherein the pulse-width converter comprises:

first and second capacitors; and first, second and third transistors each having a control electrode and first and second controlled electrodes, the first controlled electrodes of said first and second transistors being connected to a first terminal of a voltage supply, the second controlled electrode of the first transistor being connected through said first capacitor and through the first and second controlled electrodes of the third transistor to a second terminal of the voltage supply, the junction between the first capacitor and the first controlled electrode of the third transistor being connected to the control electrode of the second transistor, the second controlled electrode of the second transistor being connected through said second capacitor to the control electrode of the first transistor, the junction between the control electrode of the first transistor and the second capacitor being connected to the second terminal of the voltage supply, the control electrode of the third transistor being connected to receive said error correction signal, the second controlled electrode of the second transistor being connected to said second terminal of said voltage supply via said pulse-operated air-fuel proportioning device disposed in the air bleed conduit means, so that the first capacitor is charged linearly through the first and second controlled electrodes of the third transistor when the first transistor is conductive at a rate proportional to the error correction signal to thereby render the second transistor conductive when the voltage across the first capacitor reaches the threshold level of the second transistor for a duration inversely proportional to the error signal, whereby the air-fuel proportioning device is activated at periodic intervals related to the error correction signal.

* * * * *